United States Patent [19]

Locker

[11] 4,142,456

[45] Mar. 6, 1979

[54] AIR DIFFUSER

[76] Inventor: Howard W. Locker, 820 N. Ocean Blvd., Delray Beach, Fla. 33444

[21] Appl. No.: 817,222

[22] Filed: Jul. 20, 1977

[51] Int. Cl.[2] ..... F24F 7/00

[52] U.S. Cl. ..... 98/40 D; 98/108; 239/502; 239/552; 98/40 V

[58] Field of Search ..... 98/40 V, 40 N, 40 D, 98/40 R, 108; 239/502, 518, 552

[56] References Cited

U.S. PATENT DOCUMENTS

| | | | |
|---|---|---|---|
| 2,504,472 | 4/1950 | Van Alsburg et al. | 98/40 D |
| 2,658,440 | 11/1953 | Lange | 98/40 V |
| 3,232,206 | 2/1966 | Kennedy | 98/40 D |
| 3,854,386 | 12/1974 | Hedrick | 98/40 D |

FOREIGN PATENT DOCUMENTS

| | | | |
|---|---|---|---|
| 1093042 | 11/1960 | Fed. Rep. of Germany | 98/40 V |
| 2301693 | 1/1973 | Fed. Rep. of Germany | 98/108 |
| 177186 | 11/1935 | Switzerland | 98/40 V |

*Primary Examiner*—H. Hampton Hunter
*Attorney, Agent, or Firm*—Hauke and Patalidis

[57] ABSTRACT

An air diffuser for a ceiling or wall conditioned air outlet. The diffuser separates the flow of air from the outlet to the ambient into a plurality of diverging air jet streams by means of a plurality of regularly disposed wedge-shaped fins, with the result that air flowing from the outlet is diffused and substantially uniformly distributed throughout an enclosure, without causing uncomfortable drafts. Additionally, the ceiling type diffuser of the invention is preferably provided with a conically shaped baffle disposed across the direct flow of air from the outlet, and causing the air to be evenly distributed through the apertures between consecutive wedge-shaped fins and directed evenly along the ceiling and at a small angle downwardly.

6 Claims, 7 Drawing Figures

FIG. 1
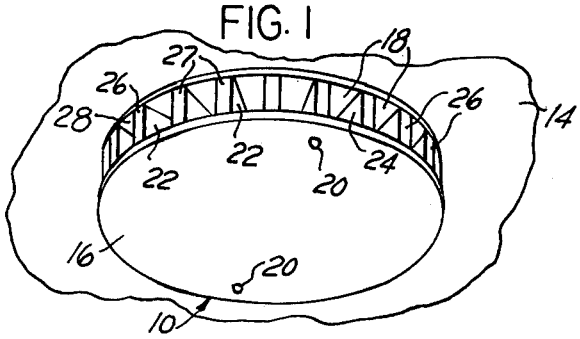
FIG. 2
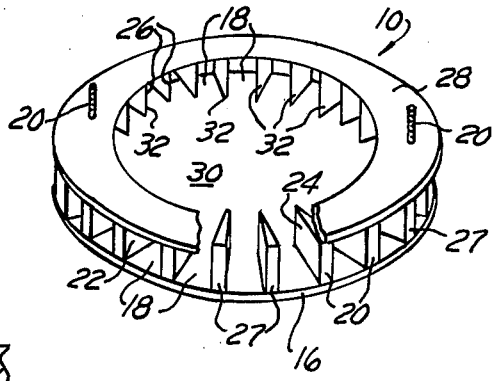
FIG. 3
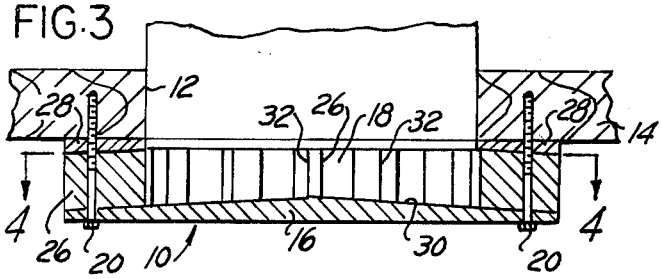
FIG. 4
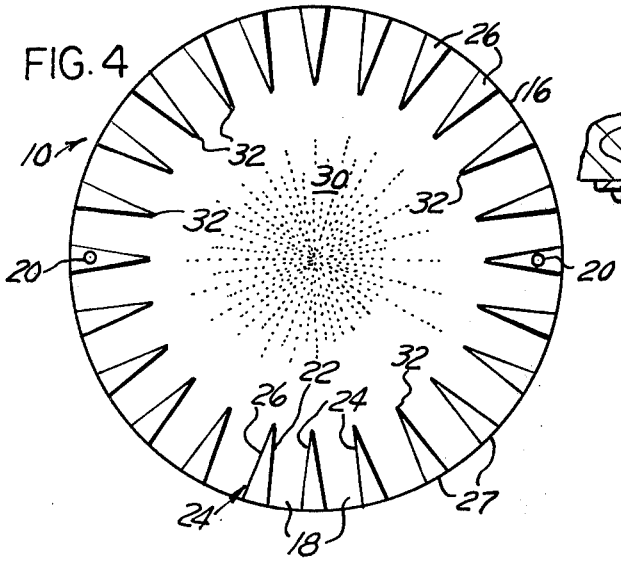
FIG. 7
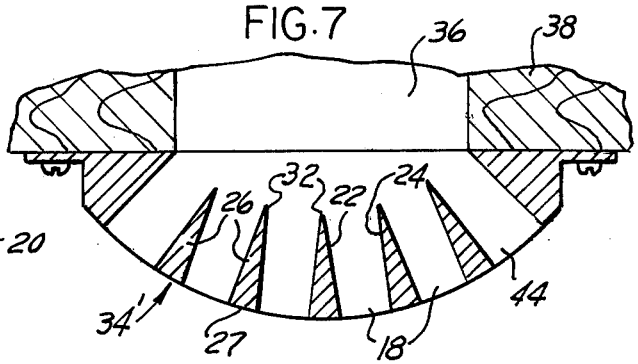
FIG. 5
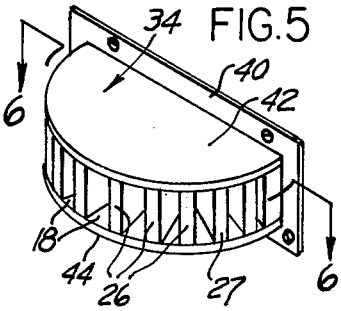
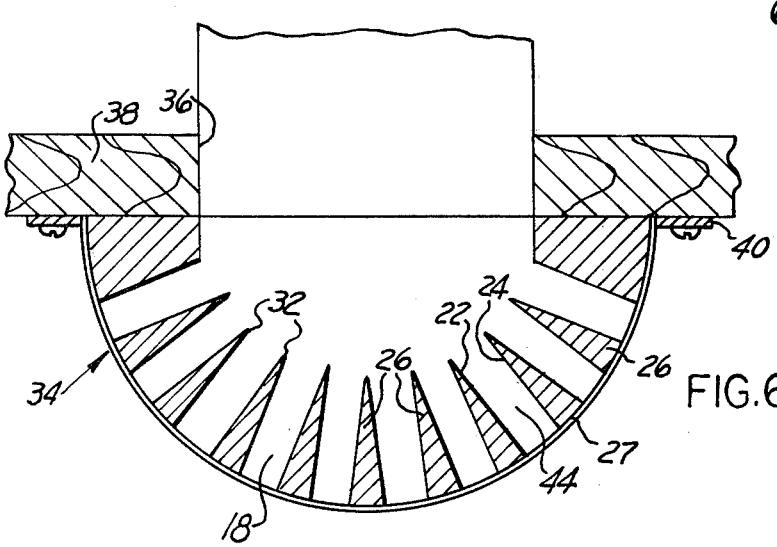
FIG. 6

AIR DIFFUSER

BACKGROUND OF THE INVENTION

Conditioned air, either heated air, cooled, air, dehumidified air, humidified air, or mixtures thereof, is distributed into diverse enclosed spaces within a building by means of appropriate ducts leading into appropriate ceiling outlets or wall outlets. Diverse types of diffusers have been designed in the past, some provided with dampers and with fins that may be individually adjustable, for attempting to provide effective distribution of the conditioned air according to the particular conditions prevalent in the enclosed spaces.

A particular disadvantage of the types of air diffusers heretofore available is that they are generally incapable of providing even distribution of conditioned air throughout the enclosed space, without creating drafts and uneven distribution of the conditioned air, with the result that, more particularly with respect to cooled conditioned air, uncomfortable blasts of cold air are prevalent in some areas of the enclosed space, while other areas remain uncomfortably warm.

The present invention remedies the inconveniences of the prior art by providing air diffusers for ceiling outlets as well as for wall outlets which are particularly effective in preventing direct flow of air into the enclosed space, which are particularly effective in slowing down the flow of air in distributing the conditioned air evenly throughout the space, and in mixing the conditioned air thoroughly with the secondary air, or air already present in the space.

The diffusers of the present invention present particular advantages where it is desirable to cool the air supplied to an enclosed space. By separating the flow of cooled air into separate individual streams or jets, the invention permits to mix the room air, or secondary air, with the cooled air without causing drafts or uncomfortable wide heat gradients. As the incoming cool air is thoroughly mixed with the secondary air, better control of the temperature within the enclosure is provided, and the location of the return air openings is no longer critical. Smooth and even air circulation and ventilation, are provided, without stratification or separation between cold and warm air, and there is no longer any requirement to re-heat cooled air before distributing to a confined space to avoid ingress into the space of contrasting low temperature air currents. The air diffuser of the present invention thus promotes considerable savings in energy.

SUMMARY OF THE INVENTION

The several objects and advantages of the present invention are accomplished by providing a diffuser structure for ceiling outlets and for wall outlets which separates the incoming air into a plurality of separate radial jets which thoroughly mix the secondary air in an enclosure with the conditioned air of the jets. The invention accomplishes its purposes by providing a diffuser wherein the incoming air is separated in the radial jets by way of fixed wedge-shaped fins, regularly disposed about the periphery of the diffuser so as to provide a plurality of substantially square, in section, conduits of substantially constant area for dividing the flow of air in such a plurality of radial jets.

The many objects and advantages of the present invention will become more apparent to those skilled in the art when the following description of some of the best modes contemplated for practicing the invention is read in conjunction with the accompanying drawing wherein like numerals refer to like parts and in which:

BRIEF DESCRIPTION OF THE DRAWING

FIG. 1 is a perspective view of a ceiling type air diffuser according to the present invention;

FIG. 2 is a perspective view of the diffuser of FIG. 1 removed from over a ceiling air outlet, with portions broken away for showing the internal construction;

FIG. 3 is a transverse section of the diffuser of FIGS. 1–2, shown mounted over a ceiling air outlet;

FIG. 4 is a cross section from line 4—4 of FIG. 3;

FIG. 5 is a perspective view of an example of structure for a wall air diffuser according to the present invention;

FIG. 6 is a cross sectional view along line 6—6 of FIG. 5; and

FIG. 7 is a view similar to FIG. 6, but showing a modification thereof.

DETAILED DESCRIPTION OF THE PREFERRED EMBODIMENTS

Referring to the drawing and more particularly to FIGS. 1–4 an air diffuser 10 according to the present invention, and adapted for placing over an air outlet 12, FIG. 3, in a ceiling 14, consists principally of a baffle plate member 16 disposed a short distance away from the plane of the ceiling and diverging the flow of air through a plurality of nozzles 18 regularly disposed peripherally, relative to the baffle plate 16, between the plane of the ceiling 14 and the baffle plate 16. Appropriate fasteners, such as a pair of screws 20, for example, are used for attaching the diffuser 10 over the air outlet 12.

Each of the nozzles 18 is formed between the opposite sidewalls 22 and 24 of consecutive wedge-shaped members or fins 26 radially disposed with their thickest end 27 about flush with the peripheral edge of the baffle plate 16, a ring member 28 being fastened on the top of the wedge members 26 in any convenient manner. Preferably, and as best shown at FIG. 4, the ring 28 has a greater thickness at its periphery than at its inner edge, such that the plane of the lower surface of the ring 28 forms a predetermined angle relative to the plane of the ceiling 14, an angle of 7° having been found convenient to deflect the streams of air through the nozzles 18 away from the surface of the ceiling 14. Preferably, the baffle plate 16 has a conical upper surface 30 disposed at an angle equal to the angle at which the lower surface of the ring 28 is disposed, such that each nozzle 18 has substantially parallel upper and lower walls, but is arranged to deliver separate streams or jets of air, one through each nozzle 18, directed downwardly at the angle determined by the angularity of the lower surface of the ring 28 and the upper surface 30 of the baffle 16. It will be appreciated that other angles may be used, and that in some installations, both the ring 28 and the baffle plate 16 may be provided with respectively a lower surface and an upper surface parallel to the plane of the ceiling 14.

The cross area of each nozzle 18 is preferably square for best efficiency. In the structure illustrated at FIGS. 1–4 twenty-four wedge membes or fins 26 are used, each one having its sidewalls 24 and 26 relatively disposed at an angle of about 15°, and the inner tip, or leading edge 32 of each wedge member 26 being sharp such as to prevent turbulent or eddy air current flow into the nozzles 18.

Although the air diffuser 10 may be made of separate elements made of sheet metal such as sheet steel or aluminum, for example, or alternatively of some elements made or molded from metal and others made of molded plastics, it will be readily apparent that the air diffuser 10 may be molded in a single piece.

The air diffuser 10 mounted over a ceiling air outlet 12, according to the structure illustrated at FIGS. 1–4, forms an enclosed air vortex producing chamber which provides a most efficient arrangement for deflecting and evenly distributing air through the nozzles 18 disposed about the periphery of the diffuser. As a result of forming the diverging nozzles 18 with oppositely parallel walls, the air streams, or air jets, through the nozzles 18 are in the form of separate radial jets diverging from each other at an angle of about 15°. Such an arrangement is particularly efficient in entraining secondary air, that is air already contained in a room or enclosure provided with the diffuser 10 of the invention, and is particularly adapted to thoroughly mix the cooled, or heated, air from the jets with the secondary air. It has been observed that four to six parts of secondary air becomes thoroughly mixed with one part of cooled air, for example, flowing through each nozzles 18, with the result that the enclosure is thoroughly conditioned without drafts and without direct flow of cooled air impinging upon the occupants of the enclosure. Some of the critical structural parameters which have been found experimentally relate to providing the nozzles 18 with parallel sidewalls 22 and 24 and preferably with parallel upper and lower walls, and with a rectangular cross area approaching a square cross area. For best mixing of the jets or streams with secondary air the angle of divergence of the jets through the nozzle 18 must be in the neighborhood of 15°.

FIGS. 5–6 illustrate an application of the principle of the invention to a wall diffuser 34 which, in the example illustrated, is substantially semi-circular in plan view, and which is mounted over an air outlet 36 through an enclosure or room wall 38. The wall diffuser 34 is provided with a mounting flange 40 having appropriate mounting holes and fasteners for attaching to the wall 38 over the air outlet 36.

The wall diffuser 34 comprises a substantially semi-circular upper baffle plate 42 and a lower baffle plate 44 disposed substantially parallel to the upper baffle plate 42. Between the two baffle plates 42 and 44 there is disposed a plurality of radially arranged wedge members or fins 26 forming a plurality of substantially parallel-sided and square, in section, nozzles 18 providing separate air jets diverging at an angle of substantially 15° from each other.

FIG. 7 represents a section through the wall diffuser 34' according to the present invention which is designed to project less from a wall than the wall diffuser 34 of FIGS. 5–6. The wall diffuser 34' is provided with a lesser number of wedge shaped members or fins 26 defining, between the lower baffle 44 and an upper baffle plate, not shown, a plurality of parallel sided jet nozzles 18, diverging preferably at an angle of 15° from each other, six such nozzles 18 being provided to cover an angle of approximately 90° between the extreme jet nozzles.

Any appropriate damper means may be provided to cooperate with the air diffusers of the present invention to regulate the rate of flow of air through the diffuser, if so desired. Such damper may take the form of an appropriate vane or butterfly valve, for example, preferably multi-vane placed in the air duct proximate to or at the air outlet in the ceiling or wall.

Having thus described the present invention by way of examples of structural embodiments thereof, modifications whereof will be apparent to those skilled in the art, what is claimed as new is as follows:

1. An air diffuser for an air outlet comprising substantially parallel upper and lower baffle means for confining therebetween and for directing the flow of air from said outlet to a predetermined direction, and a plurality of regularly disposed nozzles formed between said upper and lower baffle means and dividing the flow of air from said outlet into separate mutually diverging streams, each of said nozzles having substantially parallel opposite sidewalls and being substantially square in section, said nozzles having outlets generally disposed about at least an arc of a circle with the axes of consecutive nozzles being mutually disposed at an angle of at least about 15° wherein said nozzles are formed by wedge-shaped stationary fin members regularly and equally radially disposed about the periphery of said top and bottom baffle means, said wedge-shaped fin members having a sharp leading edge of about 15° disposed upstream of the flow of air through said nozzles, and the opposite sides of a pair of consecutive ones of said wedge-shaped members being substantially parallel.

2. The diffuser of claim 1 for mounting over a ceiling air outlet wherein said lower baffle means is shaped as a circular disk and said upper baffle means is shaped as a ring.

3. The diffuser of claim 2 wherein said circular disk has a conical upper surface.

4. The diffuser of claim 3 wherein said ring has a lower surface substantially parallel to said conical surface.

5. The diffuser of claim 3 wherein said conical surface and the lower surface of said ring member are disposed at an angle of at least 7° relative to the horizontal for downwardly directing said separate air streams through said nozzles.

6. The diffuser of claim 1 for mounting over a wall outlet, wherein said upper and lower baffle means are formed by substantially parallel plates of equal area and shaped as a sector of a circle, and said nozzles are formed by said wedge shaped fin members mounted between said upper and lower baffle plates about the periphery thereof and radially disposed at angles of at least 15°.

* * * * *